United States Patent [19]

Strasser

[11] Patent Number: 4,995,237

[45] Date of Patent: Feb. 26, 1991

[54] METHOD FOR CARRYING OUT MAINTENANCE WORK ON A REFRIGERATOR, DEVICE AND REFRIGERATOR FOR CARRYING OUT THE METHOD

[75] Inventor: Wilhelm Strasser, Bergisch Gladbach, Fed. Rep. of Germany

[73] Assignee: Leybold Aktiengesellschaft, Hanau, Fed. Rep. of Germany

[21] Appl. No.: 110,936

[22] Filed: Oct. 20, 1987

[30] Foreign Application Priority Data

Oct. 20, 1986 [DE] Fed. Rep. of Germany ..... 3635604

[51] Int. Cl.[5] ..... F25D 17/06

[52] U.S. Cl. ..... 62/93; 62/55.5; 62/275; 62/6

[58] Field of Search ..... 62/292, 275, 298, 276, 62/77, 6, 272, 55.5, 94, 93

[56] References Cited

U.S. PATENT DOCUMENTS 3,918,268 11/1975 Nussbaum ..... 62/150
4,614,093 9/1986 Bachler et al. ..... 62/100 X
4,679,401 7/1987 Lessard et al. ..... 62/100 X

FOREIGN PATENT DOCUMENTS 2457336 6/1975 Fed. Rep. of Germany ..... 62/275

*Primary Examiner*—Henry A. Bennet
*Attorney, Agent, or Firm*—Kenyon & Kenyon

[57] ABSTRACT

The invention relates to a method for carrying out maintenance work on structural parts located within the housing of a refrigerator, the refrigerator being divided into two parts separable from each other so that the interior chamber of the refrigerator becomes accessible. The method is carried out by opening the housing, carrying out the maintenance work, closing the housing and thereafter sweeping the housing with working gas. In order to avoid condensation in the cold areas of the interior chamber of the refrigerator after the housing is opened, the method provides that the areas of the refrigerator housing endangered by condensations be heated locally to a temperature, which is so selected, that up to and including the sweeping process following the maintenance work, the temperature does not fall below the dew point of condensable gases.

12 Claims, 1 Drawing Sheet

Figure 1:
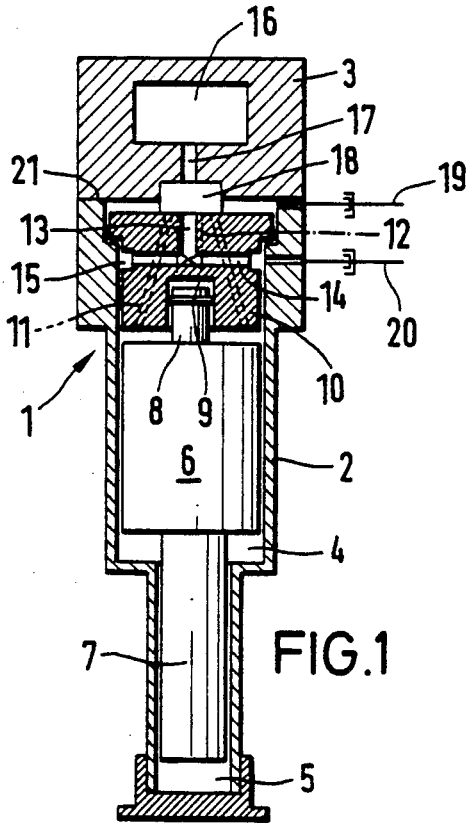

METHOD FOR CARRYING OUT MAINTENANCE WORK ON A REFRIGERATOR, DEVICE AND REFRIGERATOR FOR CARRYING OUT THE METHOD

BACKGROUND OF INVENTION

The invention relates to a method for carrying out maintenance work on structural parts within a refrigerator housing having two parts separable from each other in such a manner that the interior space of the refrigerator housing becomes accessible, whereby the housing is opened, maintenance work is carried out and the housing is closed and finally swept with a working gas. In addition, the invention relates to a device and a refrigerator for carrying out the method of the invention.

Refrigerators are low temperature cold machines, wherein thermodynamic circulation processes occur. A one-stage refrigerator comprises essentially a working space with a displacer. The working space is alternatingly connected in a specific way to a high pressure gas source and to a low pressure gas source, so that during the forced reciprocating motion of the displacer the thermodynamic circulation processes occur. Here, the working gas is led into a closed circulation system, the consequence of which is that from a given region of the working chamber heat is withdrawn. Employing two-stage refrigerators of this type with helium as the working gas, temperatures less than 10° K. can be achieved.

Generally, repair and maintenance work on structural parts located within the refrigerator housing is carried out by switching the refrigerator off and waiting for the cold regions of the refrigerator to reach room temperature. This waiting period was necessary in the absence of heating, to avoid the collection of condensable gases on the cold surfaces upon opening the refrigerator housing the condensation of which would endanger the operation of the refrigerator upon restarting. Since the temperatures of the cold surfaces of a refrigerator operated with helium are only a few degrees Kelvin (60° to 80° K. in a one-stage refrigerator or at the first cold stage of a two-stage refrigerator) nearly all gases present in the atmosphere must be considered condensable gases and, therefore, undesirable. Alternatively, the housing is sufficient preheated, prior to opening. The housing is then opened and the requisite work is carried out. The housing is then closed and thoroughly swept with the working gas before the refrigerator is again returned to service.

Maintenance work carried out in this way takes a long time, considering in total the actual repair work time, the housing preheat time and the restart time. Furthermore, operation of the equipment or instrument, which is cooled by the refrigerator, is interrupted during this time. With instruments having a high fill level of liquid helium (100:1 and more) heating the refrigerator for the sole purpose of maintenance is, for economic reasons alone, out of the question because it presupposes removal of the liquid helium. If, for example, a refrigerator cools the magnets of a nuclear spin tomograph, considering the instrument being inoperable for two to three weeks and the additional cost of helium, extraordinary expenses totaling tens of thousands of dollars would have to be acceptable if the maintenance work is to be carried out in the conventional manner.

In order to avoid long operating interruptions, it is known to undertake the maintenance work within a glove box. Using the glove box permits carrying out this work in a protective gas atmosphere. In this way, for example, condensable gases which would penetrate into the working or cylinder space of the displacer and condense on the cold surfaces are avoided. Using the glove box, therefore, has the advantage that maintenance work can be performed at still low temperatures without the requirement of preheating the cold areas of the refrigerator and the connected equipment or instrument.

Using the relatively expensive glove box is possible however, only where sufficient space is available. Moreover, the length of time for performing the maintenance work is still somewhat excessive (at least 2 hours). One reason for this is the need for several sweeping processes with concomittant relatively high protective gas consumption to create a sufficiently pure protective gas atmosphere within the glove box. Another reason can be found in the high degree of difficulty inherent in handling tools with the gloves of the glove box. Moreover, the danger exists that, for example, a displacer to be exchanged touches the box sides or the gloves in the glove box with its cold side upon being pulled out. The consequence of this is the destruction of parts customarily consisting of synthetic foil and with that a contamination of the protective gas atmosphere. In addition, temperature increases occurring during the maintenance work, which, due to using the glove box for a relatively long time, are not neglible, so that the time spent on returning to operating temperature service is significant. Finally, the costs incurred in connection with the high protective gas consumption are not inconsiderable, particularly if helium must be used.

Another displacer exchange method has been suggested, in which a protective gas stream is maintained from the moment the housing is opened until closing to prevent undesirable gases from penetrating into the cylinder chamber of the displacer. However, in this exchange method, the possibility exists that condensable gases will reach the displacer chamber, particularly, at the moment when the displacer to be exchanged is removed from the refrigerator housing. If this is done too rapidly, then not only protective gas but air also enters the displacer chamber and condenses immediately on the cold interior walls of the housing. The condensation hinders the installation of the new displacer and can only be removed at great technical expense.

OBJECT AND SUMMARY OF THE INVENTION

It is an object of the present invention to provide an improved method for carrying out maintenance work on structural parts located in a refrigerator, which can be performed rapidly while avoiding gas condensation with certainty. It is another object of the present invention to provide a device an refrigerator for carrying out the method of the invention.

According to the method of the invention the cold surfaces of the refrigerator housing endangered by gas condensation are locally heated to a temperature selected so that prior to the sweeping process and including the maintenance work, the surface temperature does not fall below the dew point of the condensable gases. The particular advantage of this method lies in the fact that it ensures with certainty that the surface temperatures do not fall below the dew point, which means that maintenance work can be carried out rapidly and unimpeded by undesirable condensations.

Local heating of housing surfaces endangered by condensation is conducted after opening the housing and removing the displacement system. Thereafter, a hot gas can be blown into the refrigerator housing until the surfaces endangered by condensation have reached such a temperature, that subsequent to turning off the hot gas stream, the maintenance, the closing of the housing and the concluding sweeping process can be conducted without the surface temperature falling below the dew point of condensable gases. A particularly useful temperature to which to heat the surfaces is approximately 50° to 60° C. A final surface temperature of this order of magnitude ensures that in the time in which the refrigerator housing, after discontinuing the hot gas stream, is still open, that the surface temperature does not fall to values below the dew point of condensable gases. As a result, immediately following the sweeping process, the serviced refrigerator is again available for operation.

In another embodiment of the invention, surfaces endangered by condensation are locally heated with heating devices to maintain the local surface temperature above the dew point of condensable gases. It is advisable to use electric heaters for this purpose, which are arranged in the area of the cold stage(s). Heating devices of this nature can, for intended maintenance, be turned on before the housing is opened and can be operated for a length of time which with certainty prevents condensation in the displacer chamber after the refrigerator housing is opened. The particular advantage of this method lies in that displacers frozen from contamination can be freed and made functioning again or can be simply exchanged.

Further advantages and details of the invention are described below in conjunction with embodiments represented in the drawings.

BRIEF DESCRIPTION OF THE DRAWINGS AND DETAILED DESCRIPTION OF THE INVENTION

Figure 2:
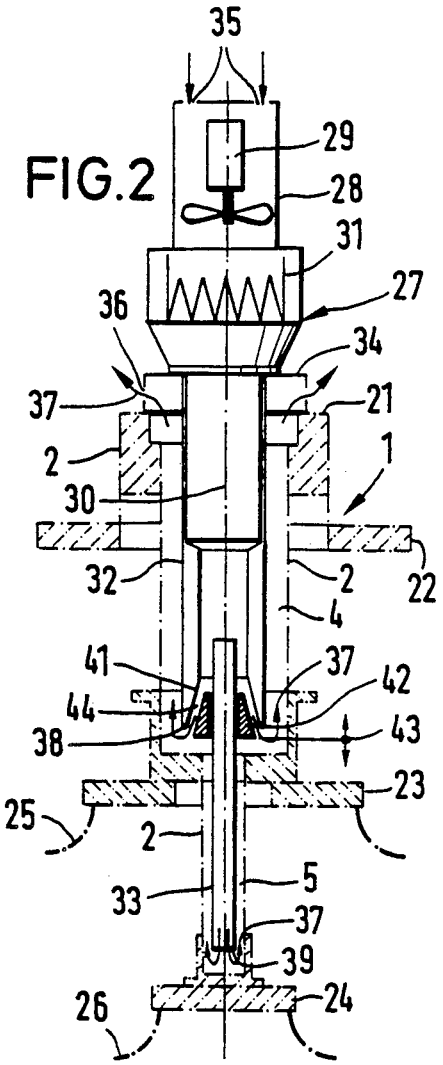
Figure 4:
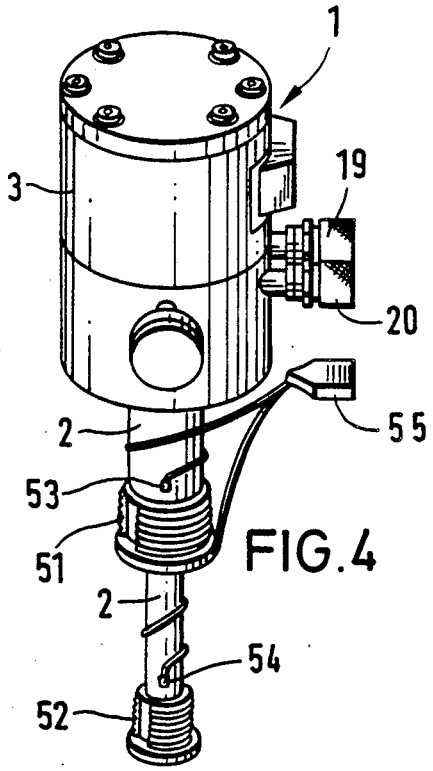
Figure 3:
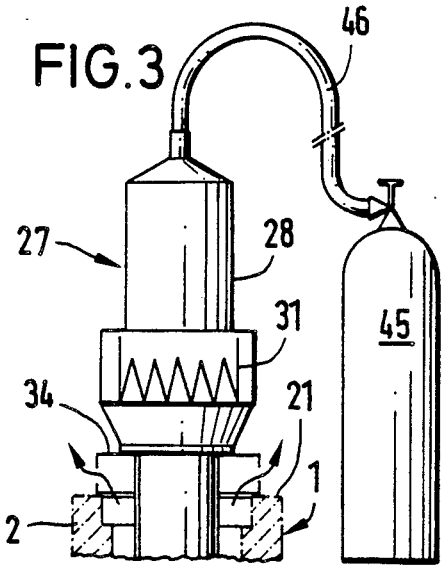

FIG. 1 is a cross sectional view through a refrigerator of the present invention;

FIG. 2 schematically illustrates a refrigerator housing connected to low temperature equipment and to a hot gas blower placed into it;

FIG. 3 illustrates a hot gas blower connected to a compressed gas bottle; and FIG. 4 illustrates an alternate embodiment of a refrigerator equipped with electric heating devices according to the invention.

Referring to the drawings and first to FIG. 1 there is shown a refrigerator 1 comprised of a housing, having housing parts 2 and 3. In housing part 2, cylindrical work chambers 4 and 5 are provided for displacer stages 6 and 7.

The upper displacer stage 6 is equipped with a drive piston 8, and an associated cylinder 9 which is kept in a guide bush 10. The guide bush 10 is provided with bores 11, 12, and 13. Bore 11 opens into the working chamber 4 and serves to supply chamber 4 with a working gas. The central bore 13 ends in a transverse bore 14, which is connected with a ring groove 15 in the outer wall of the guide bush 10. Two further bores 12 are indicated by dash-dot lines and serve to pneumatically drive the system consisting of the displacers 6 and 7. The different bores lie in planes differing from the plane of projection so that they do not cross each other, which is indicated hatched or with dash-dot lines respectively.

In the housing part 3 a control motor 16 is located, which actuates a control valve 18 through shaft 17. This control valve 18 serves in a manner known per se to supply the various bores with high and low pressure working gas, preferentially helium.

The connections for the high pressure and the low pressure working gas are labeled 19 and 20, respectively. A separating plane 21 between the housing parts 2 and 3 lies at the level of the control valve 18. Upon removal of the upper housing part 3 with motor 16 and valve 18 and upon further removal of the guide bush 10, displacers 6 and 7 become accessible and can be exchanged within the framework of maintenance.

During operation of the refrigerator 1, the working gas is under high pressure and flows through connection 19 into the refrigerator 1. Control valve 18 supplies the different bores 11 and 12 with the high pressure working gas. After expansion in the refrigerator stages, the working gas penetrates into bores 13, 14 and flows through to the ring groove 15 and out the low pressure connection 20. The working gas pressure at the high pressure connection 19 is customarily 22 bar, while the working gas pressure at the low pressure connection 20 is approximately 7 bar.

The structural parts within the interior of the refrigerator housing most subject to wear and tear are, in particular, the motor 16, the valve 18, and the displacement system 6 and 7 (only partially shown). Maintenance work on these parts can only be performed after the housing part 3 is removed so that even in the case where the guide bush 10 and the displacement system 6 and 7 can remain in the housing part 2, condensation in the other cold stages cannot be prevented.

The manner of carrying out maintenance work according to the invention is intended to be explained in conjunction with FIG. 2. FIG. 2 represents schematically the lower housing part 2 of the refrigerator, which is connected to low temperature equipment, such as a superconducting magnet (not shown). To this end, the housing 2 itself is equipped with a flange 22, which, in turn is connected to the housing of the low temperature equipment. To each cold stage of the refrigerator 1 a flange 23 or 24 is heat conductively fastened. These flanges, in turn, are connected over cold bridges indicated by dash-dot lines with one temperature label of the desired temperature (first stage flange 23: approximately 60° to 80° K.; second stage flange 24: approximately 10° K.).

In order to replace the displacement system 6, 7 located within the interior 4, 5 of refrigerator housing 2 during operation of the refrigerator, the housing part 3 with motor 16 and valve 18 is lifted off and the guide bush 10 is removed. Subsequently, the displacement system 6, 7 becomes accessible and can be pulled out of the lower housing part 2. Immediately following the process of taking out the displacement system, air will stream into the interior housing chamber 4,5 and condense on the cold surfaces. In order to remove these condensations and to heat the cold areas to temperatures at which condensations no longer occur, a hot gas blower 27, the shape of which is adapted to the interior space 4,5 of the housing part 2, is introduced into the housing part 2. In the embodiment shown in FIG. 2, air is used as hot gas. The hot gas blower 27 comprises a housing 28, in which a ventilator 29 as well as a preferentially adjustable filament winding 31 is located. The longitudinal axis of the system is labeled 30. The tubular sections 32 and 33 of the blower project into the interior chamber 4, 5 of the refrigerator, respectively. The diameters of the tubular sections 32 and 33 are adapted to the diameters of the refrigerator stages in such a way, that in each instance an annular space surrounding the pipe sections 32 and 33 remains. In a single-stage refrigerator, tubular section 33 is omitted. To heat the areas contaminated by condensation, the hot air blower 27 is placed on the housing part 2 with a collar 34 and operated. The ventilator 29 draws air through inlet openings 35 and across the filament winding 31 in the direction of the pipe sections 32 and 33. The heated air flows from the pipe sections 32, 33 and through the particular outer annular spaces back to the collar 34, which is equipped with air outlet openings 36 (cf. arrow 37). The air outlet openings 38 and 39 of the pipe sections 32 and 33 lie in the region of the cold ends of the particular refrigerator stages, where the greatest amount of heat conduction is required.

In the embodiment represented in FIG. 2, the outlet opening 38 of pipe section 32 is built as an adjustable ring nozzle. To this end, the lower part 41 of the pipe section 32 enlarges conically in the direction of stream of the hot gases. Into this conically enlarged opening a likewise conical shaped part 42 is set, which is supported displacably (double arrow 43) in the direction of the longitudinal axis 30 of the hot gas blower 27. By sliding the shaped part 42 in the axial direction, the width of conical gap 44 changes so that the quantity of air streaming out can be adjusted. This adjustment permits selecting the ratio of gas streaming out of the pipe sections 32 and 33 in such a way to ensure that approximately the same temperatures are obtained in both of the refrigerator stages. Shaped part 42 also serves to simultaneously support the pipe section 33 projecting into the partial interior space 5 of the refrigerator housing 2.

After heating to sufficiently high temperatures (advisably approximately 50° to 60° C.) the blower 27 can be removed from the refrigerator housing 2. Thereafter, the temperatures will drop again until they approach dew point temperatures. However, sufficient time remains to install the new displacement system 6, 7, assemble the housing part 3 and sweep the interior chamber 4, 5 with helium. Immediately following the helium sweep, the refrigerator 1 is again available and ready to be operated.

If repairs need to be carried out only on the motor 16 or valve 18, the displacement system 6, 7 must likewise be removed from the housing part 2, in order to insert the hot gas blower 27. After sufficient heating and removal of condensation in the interior of the housing part 2 as well as on the displacement system 6, 7 and after completion of the repair, the refrigerator can be put back together and the concluding sweep process carried out.

FIG. 3 shows an alternate embodiment, in which the air as a hot gas, is replaced by an inert or working gas in a compressed gas bottle 45, preferably helium. The compressed gas bottle 45 is connected to the blower 27 with a hose line. Since the gas enters the housing 28 under pressure a ventilator 29 is not required. The remainder of the maintenance work, which frequently includes exchanging the displacement system 6, 7, is carried out in the manner described in conjunction with FIG. 2. This embodiment is then of particular advantage, when due to the presence of magnetic fields the danger of disturbing a ventilator 29 exists.

In the embodiment according to FIG. 4, the refrigerator 1 itself is equipped with heating devices 51, 52. These are arranged in the region of the cold ends of the refrigerator stages and can, depending on the geometry of the available space, be built as a ring, plate or pot heater.

If, for example, the displacement system is intended to be exchanged, the electric heaters 51, 52 are put into operation even before the housing parts 2 and 3 are opened in order to heat the cold areas to temperatures above the dew point. It is advisable to keep the heating devices operating even during the displacer exchange, so that it will not be required to heat to excessive temperatures in order to compensate decreases of temperatures during the maintenance work. It is, for example, sufficient if the temperatures in the areas of the two cold stages are heated until completion of the maintenance work to room temperature or somewhat above it (up to 20° C.) and maintained there. This method offers the additional advantage, that when doing repair work on the motor 16 or the valve 18 it is not absolutely necessary to take the displacement system 6, 7 out of the housing part 2, since the areas of the refrigerator open during operation can be heated to sufficiently high temperatures already before the housing is opened.

To maintain the mentioned temperatures, it is advisable to provide control or regulating devices. In the represented embodiment temperature sensors 53 and 54 are provided on both cold stages. A plug 55 connects the electric wires leading to heaters 51, 52 as well as the control lines leading to the sensors 53, 54 to regulating and power supply equipment (not shown).

What is claimed is:

1. A method for performing maintenance on structural components located within a refrigerator housing while preventing condensation of gases in the refrigerator, said refrigerator housing having two sections separable from each other for accessing the refrigerator interior, the maintenance being carried out by first opening the housing, completing the maintenance, and thereafter closing the housing then sweeping the housing with a working gas, the method comprising heating local areas of the refrigerator housing endangered by condensation to a temperature prior to the maintenance which ensures that the maintenance and working gas sweep of the housing will be completed before the local area temperature falls below the dew point of condensable gases.

2. The method of claim 1, wherein said heating of local areas of the refrigerator housing is conducted after separation of the two sections of the housing and removal of a displacer system by a hot stream blown into the refrigerator interior until the local areas endangered by condensation are heated to a temperature such that subsequent to termination of the hot air stream, the maintenance and working gas sweep of the housing will be completed before the local area temperature falls below the dew point of the condensable gases.

3. The method of claim 1, wherein said heating of the local areas of the refrigerator housing endangered by condensation is carried out for the duration of the maintenance by means of a plurality of heaters positioned about the local areas.

4. A device for heating an interior of a refrigerator housing to prevent condensation of gases in the region of one or more cold stages of the refrigerator during maintenance on components within the refrigerator housing, said device comprising:

a hot gas blower defining a blower housing dimensioned to be at least partially received within the refrigerator housing, and at least one first tubular section coupled on one end to said blower housing and dimensioned to be received within a cylindrical cold stage of the refrigerator, said first tubular section defining a hot gas outlet arranged to be received within a region of the cold end of the cold stage of the refrigerator to permit gases from said hot gas blower to flow therethrough, said first tubular section being dimensioned so that an annular space is defined between said first tubular section and the refrigerator housing to permit hot gas introduced by said hot gas blower to flow therethrough.

5. The device of claim 4, said device further comprising:

a second tubular section coupled to one end of said first tubular section and dimensioned to be received within another cold stage of the refrigerator, said second tubular section defining a hot gas outlet to permit gases from said hot gas blower to flow therethrough, said outlet being located to be received within the region of the cold end of the cold stage of the refrigerator, and said second tubular section being dimensioned so that an annular space is defined between said second tubular section and the refrigerator housing for removing the hot gas therefrom.

6. The device of claim 5, wherein an adjustable ring nozzle is received within said hot gas outlet of said first tubular section.

7. The device of claim 6, wherein said hot gas outlet is defined by a conical shaped wall extending inwardly from one end of said tubular section, said conical shaped wall defining a conical shaped opening therethrough, the diameter of said opening increasing in the direction of the hot gas flow passing through said hot gas outlet.

8. A device as defined in claim 7, said device further comprising:

a ring member mounted within said conical shaped wall of said first tubular section, said ring member defining a conical shaped surface received within said conical shaped wall, such that a space is defined between said conical shaped surface of said ring member and said conical shaped wall to permit the passage of gas therebetween.

9. The device of claim 8, wherein said ring member receives one end of said second tubular section to support said second tubular section.

10. The device as in any one of claims 4, 6–9, and 8, wherein said blower housing defines a plurality of air inlet openings therein.

11. The device as defined in any one of claims 4–9, and 8, wherein said hot gas blower is coupled to a compressed gas supply to pass inert gas or helium through the refrigerator.

12. The device as in either claims 4 or 5, wherein the output of said hot gas blower is adjustable to provide a variable amount of hot gas.

* * * * *